US006699073B1

(12) United States Patent
Wu

(10) Patent No.: US 6,699,073 B1
(45) Date of Patent: Mar. 2, 2004

(54) CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/317,830

(22) Filed: Dec. 11, 2002

Related U.S. Application Data

(63) Continuation-in-part of application No. 10/278,520, filed on Oct. 22, 2002.

(51) Int. Cl.[7] ..... H01R 13/648
(52) U.S. Cl. ..... 439/608; 439/579
(58) Field of Search ..... 439/608, 579, 439/108, 101, 76.1, 79, 610

(56) References Cited

U.S. PATENT DOCUMENTS 5,924,899 A 7/1999 Paagman
5,993,259 A * 11/1999 Stokoe et al. ..... 430/608
6,083,047 A * 7/2000 Paagman ..... 439/608
6,102,747 A 8/2000 Paagman
6,146,202 A * 11/2000 Ramey et al. ..... 439/608
6,217,364 B1 4/2001 Miskin et al.
6,238,245 B1 * 5/2001 Stokoe et al. ..... 439/608
6,273,762 B1 * 8/2001 Regnier ..... 439/608
6,299,483 B1 * 10/2001 Cohen et al. ..... 439/608
6,380,485 B1 * 4/2002 Beaman et al. ..... 439/579
6,428,344 B1 * 8/2002 Reed ..... 439/579
6,468,110 B2 * 10/2002 Fujino et al. ..... 439/610
6,471,547 B1 * 10/2002 Venaleck et al. ..... 439/608

* cited by examiner

*Primary Examiner*—Gary Paumen
(74) *Attorney, Agent, or Firm*—Wei Te Chung

(57) ABSTRACT

A cable assembly (1) includes an insulating housing (10) defining a number of parallel channels (14) extending in a first direction of the housing and a number of circuit modules (20) received in the housing. Each circuit module includes a circuit board (22) received in a corresponding channel of the housing, a number of cables (23) mechanically and electrically connecting with the circuit board, a metallic grounding plate (24) attached to a surface of the circuit board and a cable clamp (25) bonding the cables together. The cable clamp defines at least one through hole (266) extending in a second direction substantially perpendicular to the first direction of the housing. A fastening element (40) is inserted into the through holes of the cable clamps along the second direction and the cable clampps of the circuit modules are stringed by the fastening element.

1 Claim, 8 Drawing Sheets

CABLE ASSEMBLY

CROSS-REFERENCE TO RELATED APPLICATIONS

This patent application is a continuation-in-part (CIP) of a U.S. patent application Ser. No. 10/278,520, filed on Oct. 22, 2002, entitled "ELECTRICAL CABLE ASSEMBLY" and assigned to the same assignee with this patent application.

BACKGROUND OF THE INVENTION

1. Field of the Invention

The present invention relates to a cable assembly, and particularly to a cable assembly having a plurality of circuit boards for high speed signal transmission.

2. Description of Related Art

With the development of communication and computer technology, high density electrical connectors are desired to construct a large number of signal transmitting paths between two electronic devices. Each of these electrical connectors provides a plurality of circuit boards to thereby achieve improved signal transmission of different electrical characteristics through the connector. Such high density electrical connectors, such as cable assemblies, are widely used in internal connecting systems of severs, routers and the like requiring high speed data processing and communication.

U.S. Pat. No. 6,217,364, issued to Miskin et al., discloses a cable assembly including an insulating housing formed by a pair of substantially identical housing halves and an electrical cable with a plurality of wires terminated to conductive terminals overmolded in a plurality of thin flat wafers. The housing halves combines to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assemblage of the cable assembly. Furthermore, an engagement of the housing halves is easy to become loose due to vibration during the transportation and other matters, whereby the cable and the wafer subassembly cannot be stably retained in the housing. Thus, an electrical connection is adversely affected between the cable assembly and a complementary connector.

U.S. Pat. Nos. 5,924,899 and 6,102,747, both issued to Paagman, each disclose a cable assembly. Referring to FIGS. 4*a*–4*c* and 5*a*–5*c* of the '899 patent, the cable assembly includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules each are retained in the housing through an interference fit with the housing. When the cable assembly is required to disengage from a complementary connector, a pulling force is exerted on an exposed end of the cable for releasing the engagement between the cable assembly and the complementary connector. However, the modules may be pulled back with regard to the housing, thereby adversely affecting an electrical engagement when the cable assembly mates with the complementary connector again. Furthermore, an additional device is employed to bond the cables together, thereby increasing the cost of the production.

Hence, an improved cable assembly is required to overcome the disadvantages of the related art.

SUMMARY OF THE INVENTION

Accordingly, a first object of the present invention is to provide a cable assembly having strain relief means for substantially resisting a pulling force exerted on a cable thereof.

A second object of the present invention is to provide a cable assembly having a plurality of individual circuit boards reliably retained in an insulating housing thereof.

A third object of the present invention is to provide a cable assembly having a grounding plate for reducing crosstalk between adjacent cables thereof.

In order to achieve the objects set forth, a cable assembly includes an insulating housing defining a number of parallel channels extending in a first direction of the housing and a number of circuit modules received in the housing. Each circuit module includes a circuit board received in a corresponding channel of the housing, a number of cables mechanically and electrically connecting with the circuit board, a metallic grounding plate attached to a surface of the circuit board and a cable clamp bonding the cables together. The cable clamp defines at least one through hole extending in a second direction substantially perpendicular to the first direction of the housing. A fastening element is inserted into the through holes of the cable clamps along the second direction and the cable clamps of the circuit module are stringed by the fastening element.

Other objects, advantages and novel features of the invention will become more apparent from the following detailed description when taken in conjunction with the accompanying drawings.

DETAILED DESCRIPTION OF THE INVENTION

Figure 1:
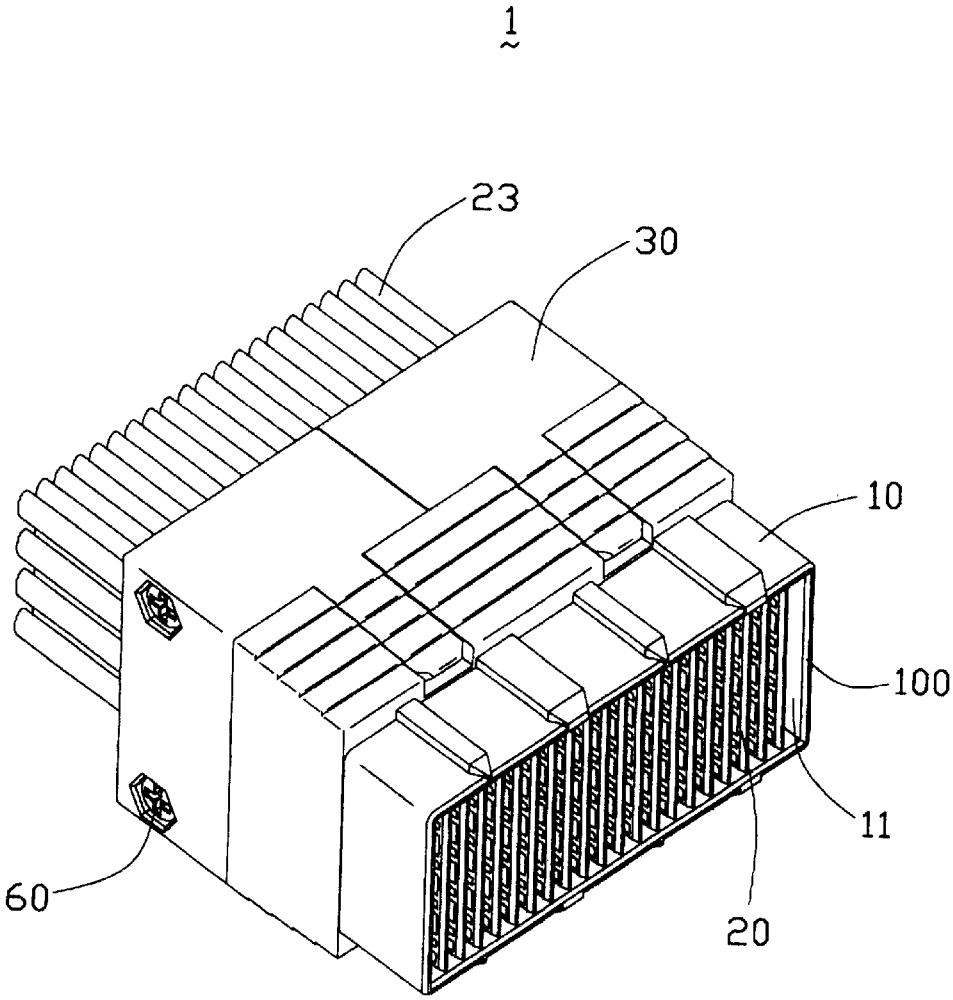
FIG. 1 is a perspective view of a cable assembly in accordance with the present invention.
Figure 2:
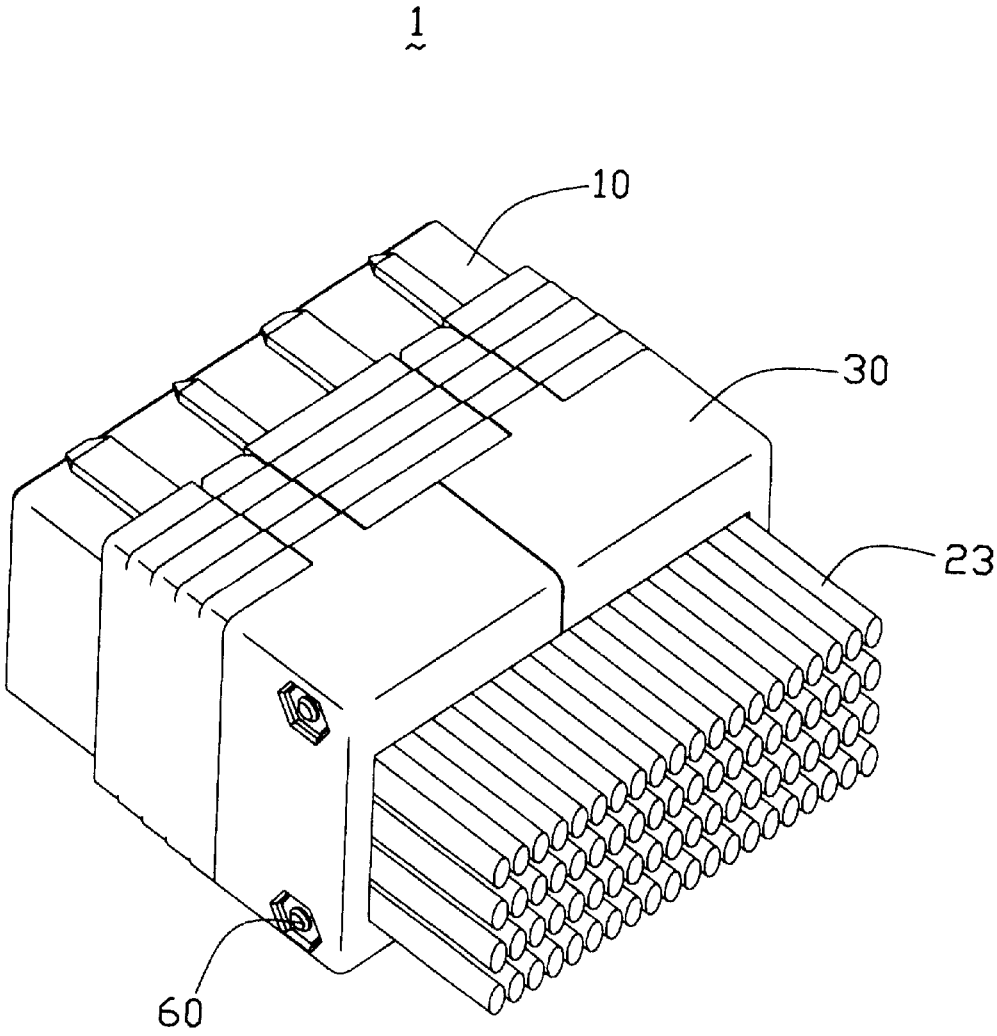
FIG. 2 is a view similar to FIG. 1 but taken from a different perspective.

Referring to FIGS. 1 and 2, a cable assembly 1 in accordance with the present invention comprises a front insulating housing 10, a plurality of circuit modules 20 received in the front housing 10 and a two-piece rear cover 30 together with the front housing 10 for retaining the circuit modules 20.

Figure 3:
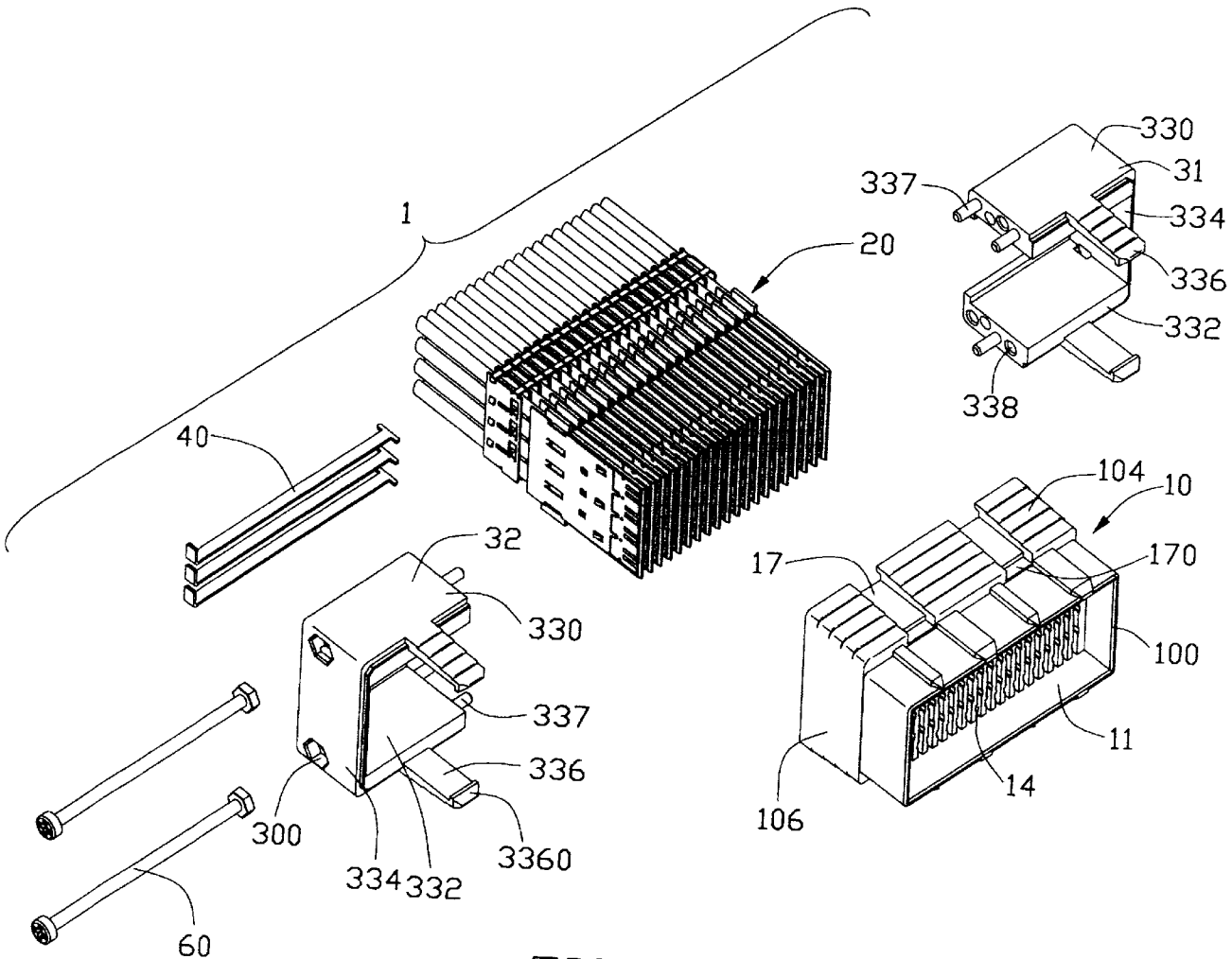
FIG. 3 is an exploded view of the cable assembly of FIG. 1.
Figure 4:
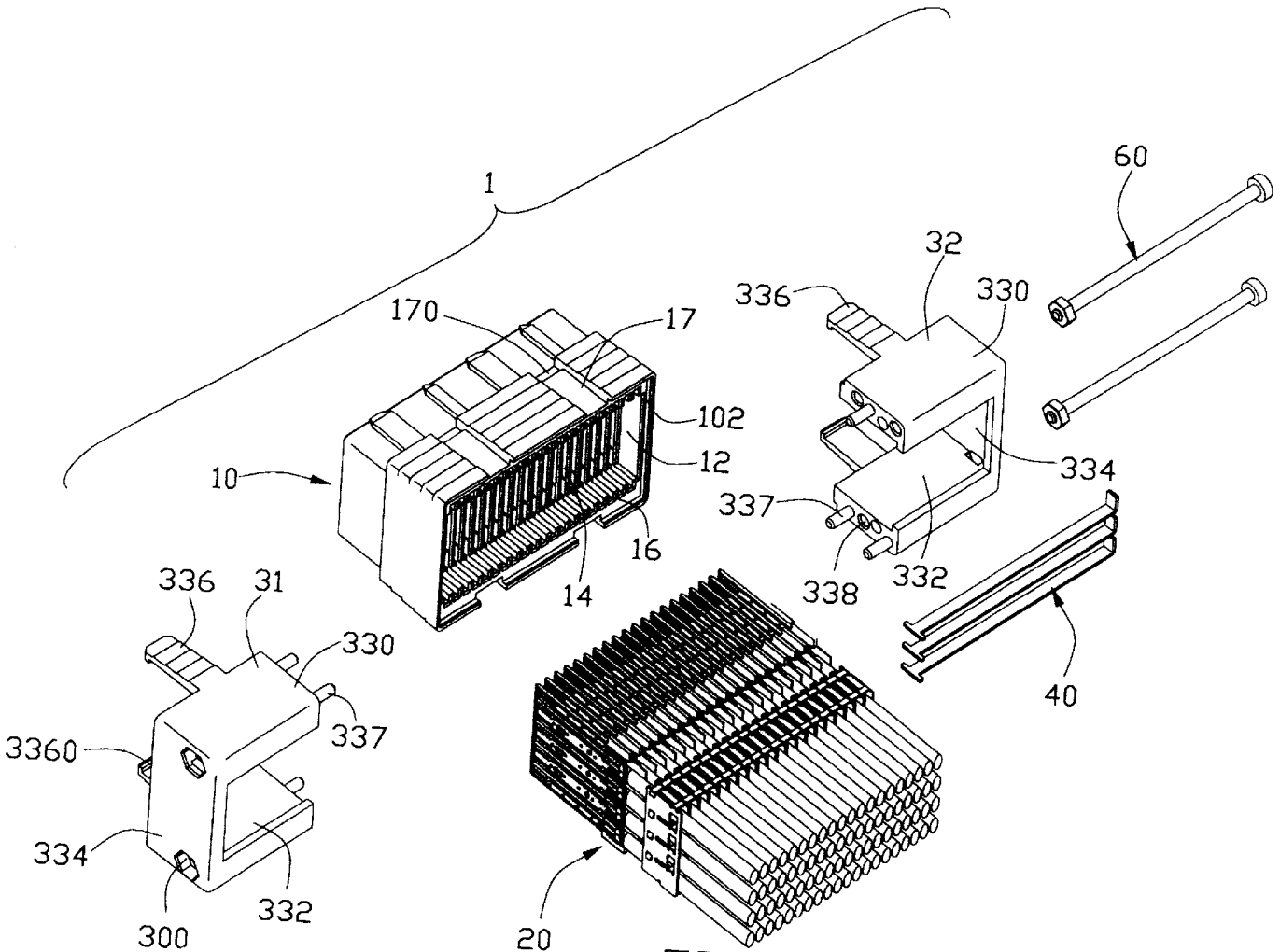
FIG. 4 is a view similar to FIG. 3 but taken from a different perspective.
Figure 5:
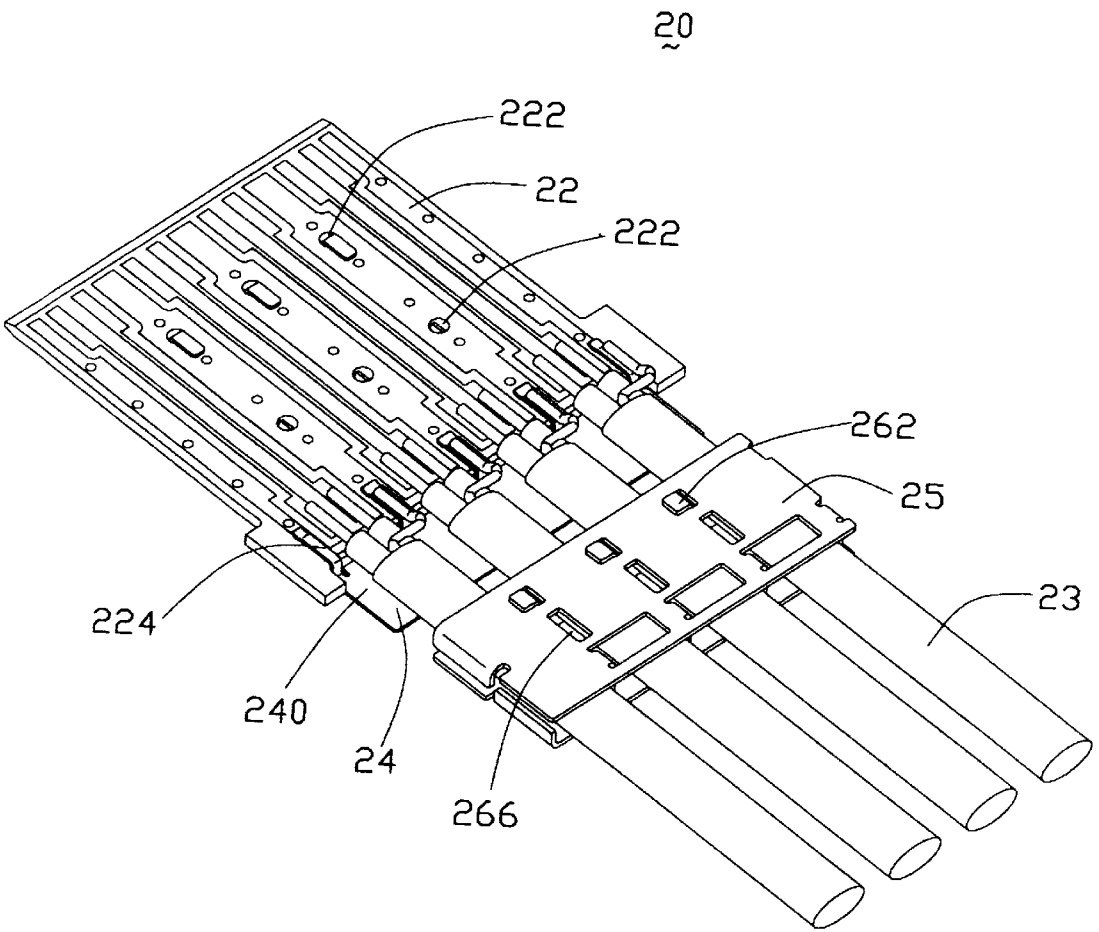
FIG. 5 is an enlarged perspective view of a circuit module of the cable assembly shown in FIG. 3.
Figure 6:
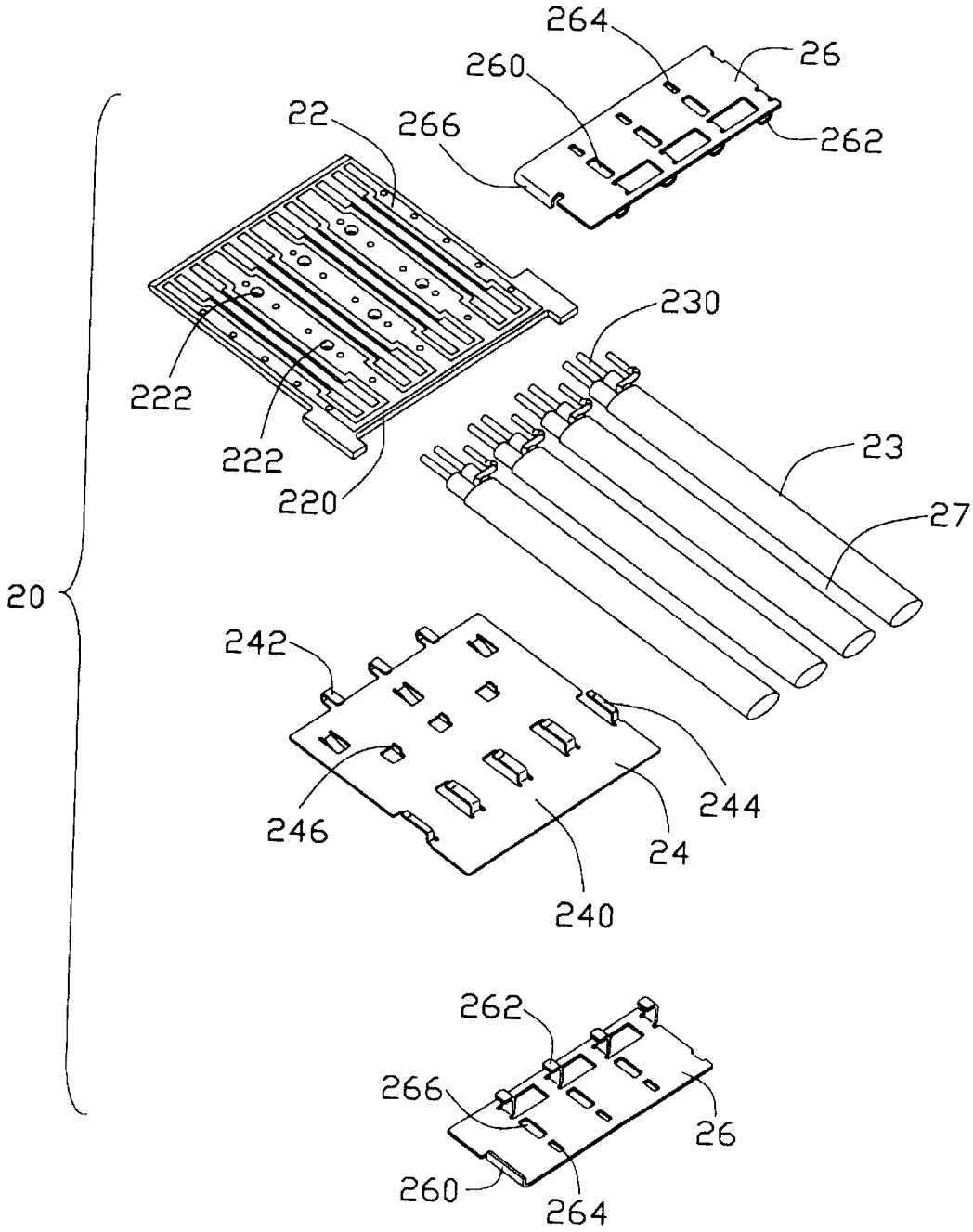
FIG. 6 is an exploded perspective view of the circuit module of FIG. 5.
Figure 7:
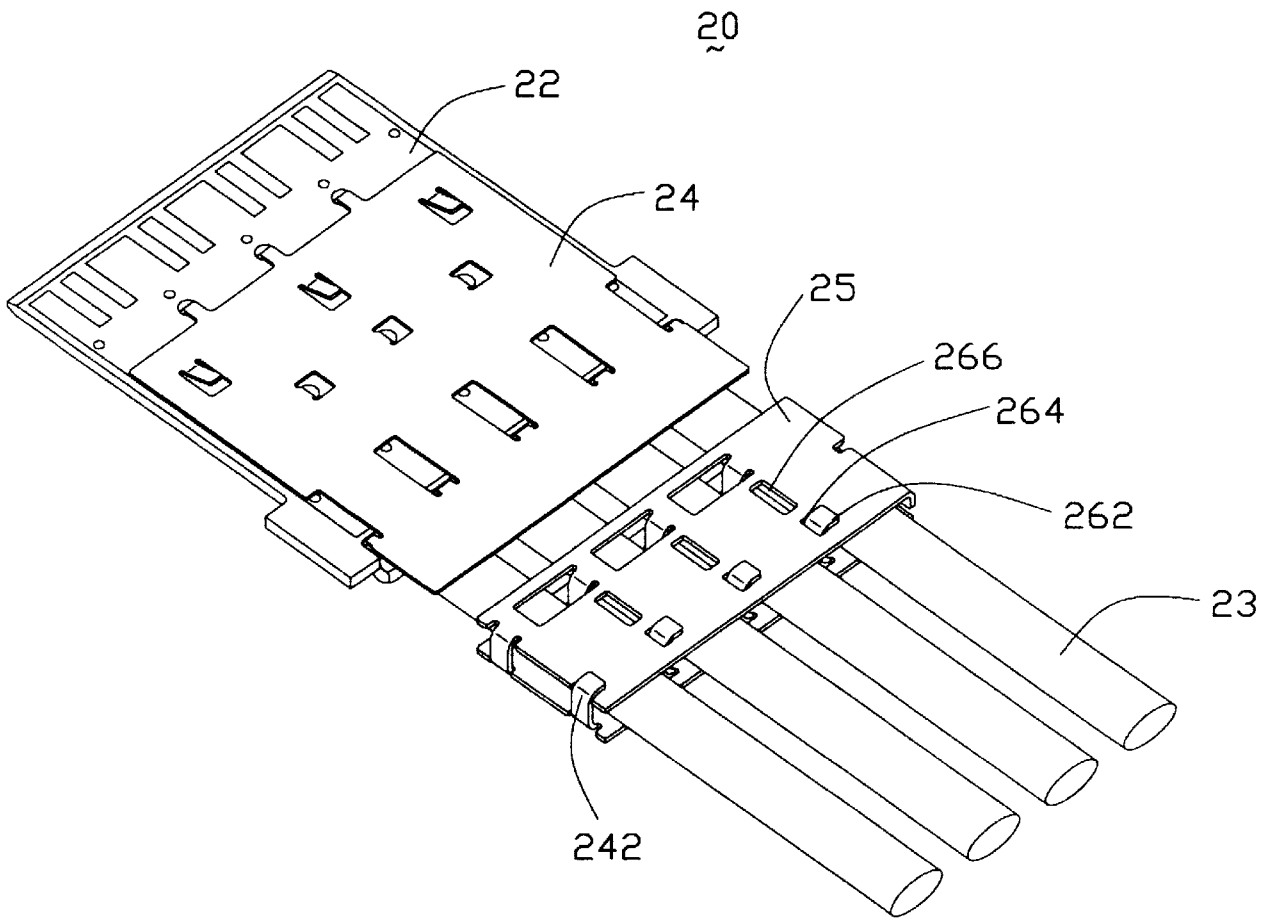
FIG. 7 is a view similar to FIG. 5 but taken from a different perspective.
Figure 8:
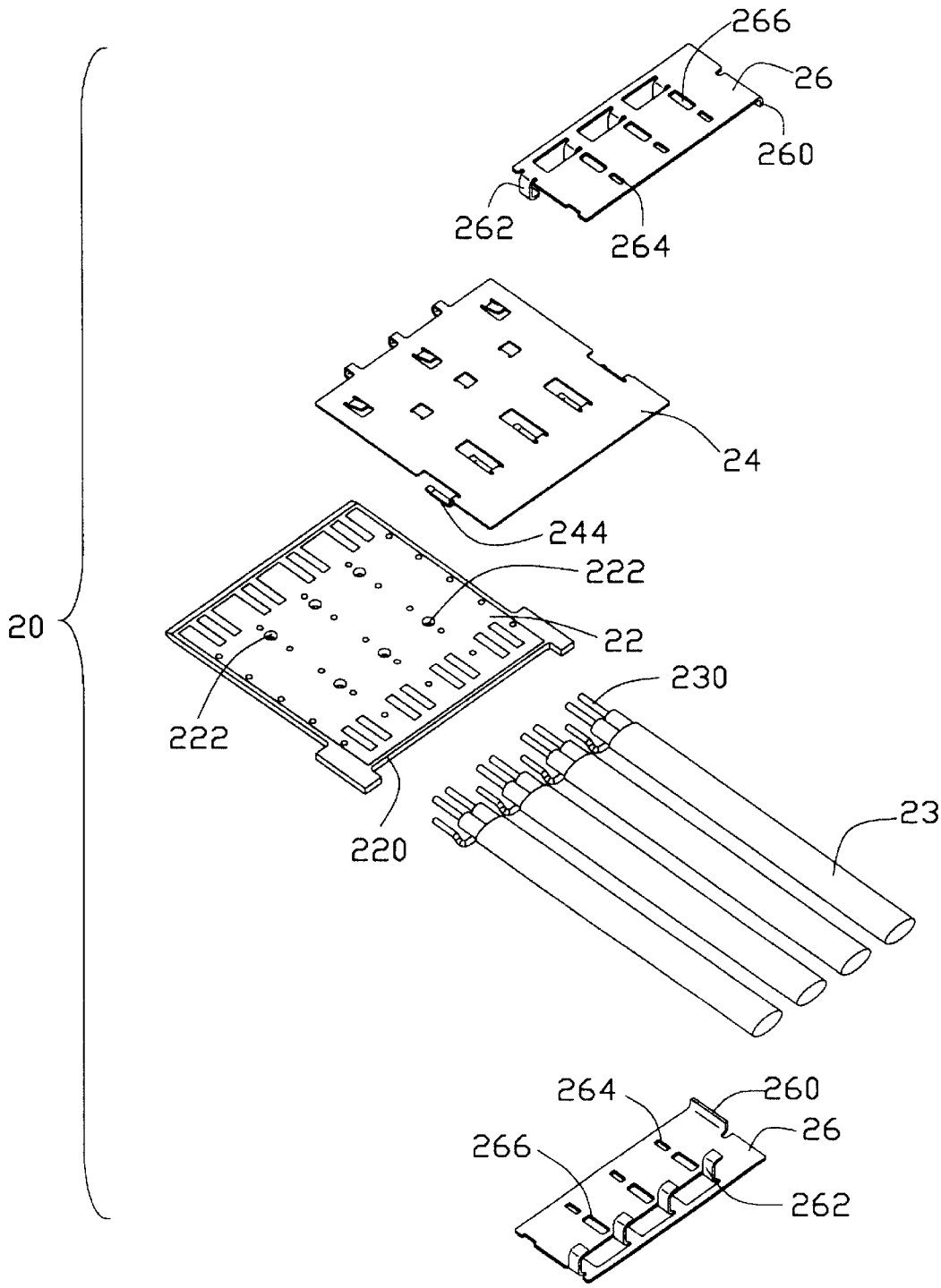
FIG. 8 is a view similar to FIG. 6 but taken from a different aspect.

Referring to FIGS. 3 and 4, the front housing 10 is generally in a rectangular shape. The housing 10 has a front mating port 11 in a front mating face 100 which faces a complementary connector (not shown) and a rear chamber 12 in a rear face 102. The housing 10 defines a plurality of parallel channels 14 extending in a front-to-back direction communicating with the front mating port 11 and the rear chamber 12 and a plurality of grooves 16 which are aligned with the channels 14. The housing 10 further defines two recesses 17 in each of a top face 104 and a bottom face (not labeled) and cavities 170 recessed downwardly from the corresponding recesses 17.

Each one of the circuit modules 20 is identical in structure and an exemplary circuit module is shown in FIGS. 5–8. Each circuit module 20 comprises a circuit board 22 and a plurality of cables 23 electrically connecting with the circuit board 22. The circuit board 22 includes a dielectric substrate made of conventional circuit board substrate material, such as FR4, a plurality of conductive signal traces (not labeled) on one side surface of the substrate for providing electrical paths through the cable assembly 1 and a plurality of grounding traces (not labeled) on both side surfaces of the substrate for grounding purpose. The circuit board 22 defines a cutout 220 at a rear end thereof and a number of through holes 222. The cables 23 of each circuit module 20 are arranged in a common plane and have leads 230 soldered to the signal traces on the circuit board 22.

The circuit module 20 further comprises a grounding plate 24 and a cable clamp 25 adapted for being applied to the cables 23. The grounding plate 24 has a front portion 240. The grounding plate 24 forms a plurality of grounding fingers 244 extending upwardly and rearward from the front portion 240 thereof. The grounding fingers 244 are soldered to the grounding traces on the opposite side surfaces of the circuit board 22 for reducing cross talk of the cables 23. The grounding plate 24 further provides three ferrules 242 and three blades 246 soldered into corresponding through holes 222 of the circuit board 22 for fixing the grounding plate 24 onto the circuit board 22.

In the preferred embodiment of the present invention, the cable clamp 25 is formed by a pair of substantially identical metal halves 26. Each metal half 26 defines a flange 260 at one side thereof, four spring tabs 262 and three holes 264. The cables 23 are bonded together by the cable clamp 25 when the spring tabs 262 of one metal half 26 engage with the corresponding holes 264 of the other metal half 26. The cables 23 are secured within the cable clamp 25 by the flanges 260 and the spring tabs 262. Each half 26 of the cable clamp 25 further defines three through holes 266 which is aligned with a corresponding gap 27 between two adjacent cables 23.

Referring back to FIGS. 3 and 4, the rear cover 30 comprises a split body having a first half 31 and a second half 32. Each half 31, 32 has a top panel 330, a bottom panel 332 and a side panel 334 formed between the top panel 330 and the bottom panel 332. Each half 31, 32 forms a pair of latches 336 extending forwardly from front edges of the top and bottom panels 330, 332, a plurality of dowel pins 337 and corresponding holes 338 for joining the first half 31 and the second half 32 together. Each latch 336 has a projection 3360 formed at a free end thereof. The rear cover 30 defines a bore 300 extending through the side panels 334 thereof. It should be noted that any other suitable connecting means may be employed to connect the first and second halves 31, 32. This split design helps to facilitate the assembly and installation of the cover 30 on to the housing 10 over the circuit modules 20.

In assembly, the circuit modules 20 are inserted into the channels 14 of the housing 10 from the rear face 102 until the circuit boards 22 arrives at a position in which front ends of the circuit boards 22 are substantially adjacent to the front mating face 100 of the housing 10. The circuit boards 22 are received in the channels 14 with top and bottom ends retained in the grooves 16. A first fastening element 40 is inserted into the through holes 266 of the cable clamps 25 for bonding the circuit modules 20 together for strain relief purpose.

The first and second halves 31, 32 of the cover 30 are assembled to the housing 10 with the projections 3360 of the latches 336 mechanically engage the cavities 170 of the recesses 17. At the same time, the first and second halves 31, 32 are connected by an interference engagement between the dowel pins 337 and the corresponding recesses 338. The cover 30 is disposed around the cable clamps 25 of the circuit modules 20. A second fastening element 60 is inserted into the bore 300 of the cover 30 for retaining the cable clamps 25 in the cover 30.

It is noted that since the circuit modules 20 are stably retained between the front housing 10 and the rear cover 30 via the second fastening elements 60, a reliable electrical engagement is ensured between the cable assembly I and the complementary connector. It is also noted that the cables 23 are clamped by the cable clamps 25 and the ferrules 242 of the grounding plates 24, more importantly, the cable clamps 25 are locked together via the first fastening element 40, whereby a pulling force exerted on the cables 23 can be substantially released.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an insulating housing defining a plurality of parallel channels extending in a first direction of the housing;

a plurality of circuit modules each including a circuit board received in a corresponding channel of the housing, a plurality of cables mechanically and electrically connecting with the circuit board, a metallic grounding plate attached to a surface of the circuit board and a cable clamp bonding the cables together, the cable clamp defining at least one through hole extending in a second direction substantially perpendicular to the first direction of the housing;

a first fastening element inserted into the through holes of the cable clamps along the second direction and bonding the circuit modules together via the cable clamps; and a rear cover assembled to the housing and together with the housing to secure the circuit modules;

wherein the cable clamp is formed by a pair of substantially identical metal halves, one metal half defining spring tabs and the other metal half defining holes receiving the spring tabs therein;

wherein the spring tabs of the cable clamp separate adjacent cables from each other in a particular space;

wherein the grounding plate has a plurality of ferrules and blades soldered to grounding traces on the circuit board;

wherein the grounding plate provides a plurality of grounding fingers electrically soldered to grounding traces on the circuit board;

wherein the rear cover includes first and second halves assembled together by a second fastening element inserted through the first and second halves and the circuit modules;

wherein the first fastening element includes a flat metallic strip while the second fastening element includes a screw and nut.

* * * * *